US011976533B1

(12) United States Patent
Thomas et al.

(10) Patent No.: US 11,976,533 B1
(45) Date of Patent: May 7, 2024

(54) EXTERNALLY THREADLESS FLOAT EQUIPMENT FOR CEMENTING OPERATIONS

(71) Applicant: Halliburton Energy Services, Inc., Houston, TX (US)

(72) Inventors: Reena Thomas, Houston, TX (US); Lonnie Carl Helms, Houston, TX (US); Frank Vinicia Acosta Villarreal, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/145,120

(22) Filed: Dec. 22, 2022

(51) Int. Cl.
*E21B 33/14* (2006.01)
*E21B 33/16* (2006.01)
*E21B 17/042* (2006.01)

(52) U.S. Cl.
CPC ..... *E21B 33/16* (2013.01); *E21B 17/042* (2013.01)

(58) Field of Classification Search
CPC ..... E21B 33/167; E21B 33/165; E21B 33/16; E21B 33/14; E21B 33/13
See application file for complete search history.

(56) References Cited

U.S. PATENT DOCUMENTS 2,662,602 A * 12/1953 Schnitter ..... E21B 33/14 166/69
3,527,299 A * 9/1970 Lewis ..... E21B 33/14 166/184
4,413,682 A * 11/1983 Callihan ..... E21B 33/14 166/217
4,961,465 A * 10/1990 Brandell ..... E21B 33/14 166/184
5,025,858 A 6/1991 Glaser
6,457,517 B1 10/2002 Goodson et al.
7,699,111 B2 4/2010 Brooks et al.
11,242,720 B2 2/2022 Santoso et al.
2003/0047314 A1 3/2003 Allamon
2016/0010400 A1* 1/2016 Goebel ..... E21B 43/10 166/382
2018/0128076 A1* 5/2018 Nguyen ..... B29C 39/10
2021/0033223 A1* 2/2021 Baldwin ..... F16L 33/34
2021/0222504 A1 7/2021 Kellner et al.
2023/0092656 A1* 3/2023 Parameshwaraiah ... E21B 34/14 166/373

FOREIGN PATENT DOCUMENTS

WO 2020117234 A1 6/2020

* cited by examiner

*Primary Examiner* — Kipp C Wallace
(74) *Attorney, Agent, or Firm* — Sheri Higgins Law, PLLC; Sheri Higgins

(57) ABSTRACT

Float collar equipment can be bonded to an inside of a casing string via an adhesive. An annulus can be located around an outside of a float collar housing and the inside of the casing string where the adhesive can be injected. The float collar housing does not require external threads or packers to secure the housing to the inside of the casing string. An injection sub can be used to inject the adhesive into the annulus. After curing or drying, the adhesive bonds the housing to the casing string. A seat, seat housing, or float shoe nose can be attached to the float collar housing via an adhesive or threads. The float collar housing can house one or more float assemblies. The float collar equipment can be bonded to the casing string at a wellsite or remote location prior to use in a cementing operation.

19 Claims, 7 Drawing Sheets

EXTERNALLY THREADLESS FLOAT EQUIPMENT FOR CEMENTING OPERATIONS

TECHNICAL FIELD

The field relates to threadless float equipment for cementing in an oil or gas operation. The float equipment can be connected to an inside of a casing string via an adhesive that bonds a float housing to an inside of a casing string.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1:
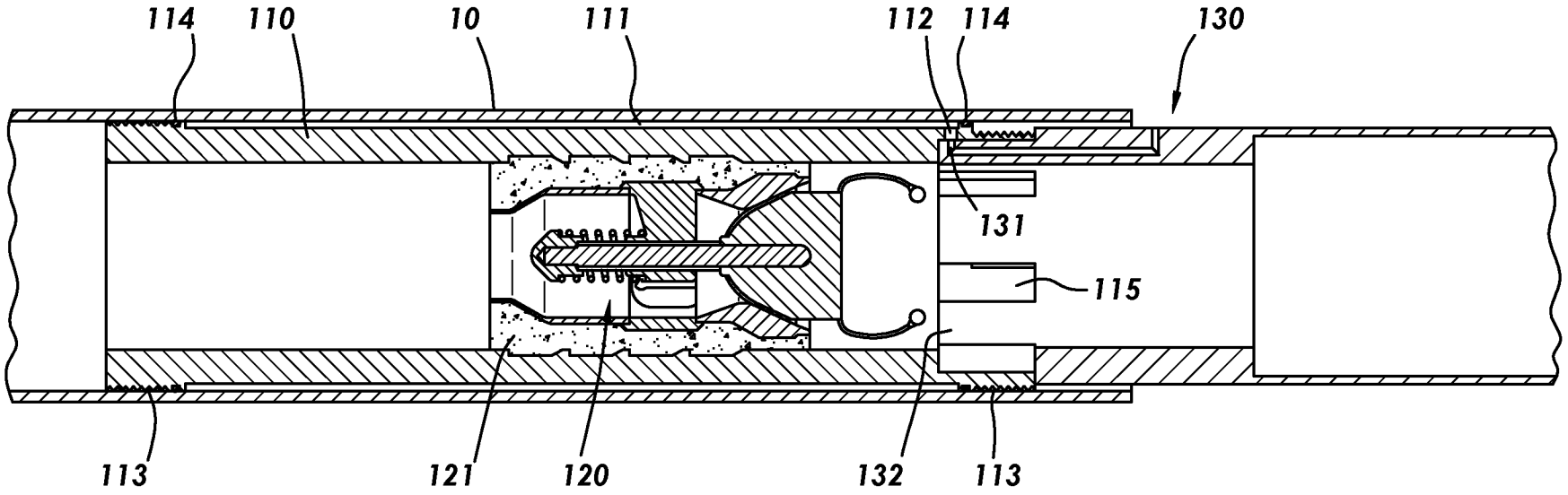
FIG. 1 is a cross-sectional view of float equipment inside a casing string and an injection sub according to certain embodiments.

Oil and gas hydrocarbons are naturally occurring in some subterranean formations. In the oil and gas industry, a subterranean formation containing oil and/or gas is referred to as a reservoir. A reservoir can be located under land or offshore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir. The oil, gas, or water produced from a reservoir is called a reservoir fluid.

As used herein, a "fluid" is a substance having a continuous phase that can flow and conform to the outline of its container when the substance is tested at a temperature of 71° F. (22° C.) and a pressure of one atmosphere "atm" (0.1 megapascals "MPa"). A fluid can be a liquid or gas. A homogenous fluid has only one phase; whereas a heterogeneous fluid has more than one distinct phase. A colloid is an example of a heterogeneous fluid. A heterogeneous fluid can be a slurry, which includes a continuous liquid phase and undissolved solid particles as the dispersed phase; an emulsion, which includes a continuous liquid phase and at least one dispersed phase of immiscible liquid droplets; a foam, which includes a continuous liquid phase and a gas as the dispersed phase; or a mist, which includes a continuous gas phase and liquid droplets as the dispersed phase. As used herein, the term "base fluid" means the solvent of a solution or the continuous phase of a heterogeneous fluid and is the liquid that is in the greatest percentage by volume of a treatment fluid.

A well can include, without limitation, an oil, gas, or water production well, an injection well, or a geothermal well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet radially of the wellbore. As used herein, "into a subterranean formation" means and includes into any portion of the well, including into the wellbore, into the near-wellbore region via the wellbore, or into the subterranean formation via the wellbore.

A wellbore is formed using a drill bit. A drill string can be used to aid the drill bit in drilling through the subterranean formation to form the wellbore. The drill string can include a drilling pipe. During drilling operations, a drilling fluid, sometimes referred to as a drilling mud, may be circulated downwardly through the drilling pipe, and back up the annulus between the wellbore and the outside of the drilling pipe. The drilling fluid performs various functions, such as cooling the drill bit, maintaining the desired pressure in the well, and carrying drill cuttings upwardly through the annulus between the wellbore and the drilling pipe.

A portion of a wellbore can be an open hole or cased hole. In an open-hole wellbore portion, a tubing string can be placed into the wellbore. The tubing string allows fluids to be introduced into or flowed from a remote portion of the wellbore. In a cased-hole wellbore portion, a casing is placed into the wellbore that can also contain a tubing string. A wellbore can contain an annulus. Examples of an annulus include but are not limited to the space between the wellbore and the outside of a tubing string in an open-hole wellbore; the space between the wellbore and the outside of a casing in a cased-hole wellbore; and the space between the inside of a casing and the outside of a tubing string in a cased-hole wellbore.

During well completion, it is common to introduce a cement composition into an annulus in a wellbore. For example, in a cased-hole wellbore, a cement composition can be placed into and allowed to set in the annulus between the wellbore and the casing in order to stabilize and secure the casing in the wellbore. By cementing the casing in the wellbore, fluids are prevented from flowing into the annulus. Consequently, oil or gas can be produced in a controlled manner by directing the flow of oil or gas through the casing and into the wellhead. Cement compositions can also be used in primary or secondary cementing operations, well-plugging, or squeeze cementing.

In cementing operations, a cement composition is circulated down through a casing string or drill string, through float equipment, and up into the annulus of the wellbore. In reverse cementing operations, a cement composition is circulated down through the annulus and up through float equipment. Float equipment generally includes a float collar body and one or more float assemblies, for example valves, that can be used to allow the cement composition to flow through the float equipment during a cementing operation and prevent the cement composition from flowing through the equipment at the end of the cementing operation. The float collar body typically includes threads around a portion of the body that is threaded into the inner diameter of a casing string. The threads must be specifically machined with threads that are capable of withstanding loads which can be quite costly. The float collar body also is typically made of metals or metal alloys that are capable of withstanding pressures in the wellbore that prevent the body from disengaging with the inner diameter of the casing string. One or more packers can be used to create a seal such that fluid flows through the float collar instead of around the tool.

At the conclusion of the cementing operation, the float equipment is generally drilled or milled out in order to remove the float equipment from the wellbore. However, float bodies that include threads can be quite labor intensive and take time to mill or drill out. Thus, there is a need for improved float equipment that solves the problems discussed above.

It has been discovered that a threadless float collar body can be used for float equipment in cementing operations. The float color body can be made from a variety of materials and connected to the inside of a casing string via an adhesive. The float equipment can be drilled or milled out in less time and can cost much less then threaded float collar bodies.

A downhole tool for cementing in a wellbore can include a float collar body configured to fit within a casing string, wherein the float collar body does not include external threads; an annulus located between an outside of the float collar body and an inside of the casing string; and an adhesive located in at least a portion of the annulus, wherein the adhesive attaches the float collar body to the inside of the casing string.

It is to be understood that the discussion of any of the embodiments regarding the downhole tool is intended to apply to all of the apparatus, system, and method embodiments without the need to repeat the various embodiments throughout. Any reference to the unit "gallons" means U.S. gallons.

Turning to the figures, FIG. 1 is a cross-sectional view of a downhole tool. The downhole tool can include a float collar body 110. The float collar body 110 can be designed to be installed within a casing string 10. The casing string 10 can also be a tubing string. The outer diameter of the float collar body 110 can be selected such that the float collar body 110 can be placed inside the casing string 10. The float collar body 110 does not include external threads. As used herein, the term "external" means at a location around the outside of the float collar body, for example, at a location along the outer diameter of the body. Threads are a helical ridge on the outside of a screw, bolt, etc. or on the inside of a cylindrical hole, that allows two separate parts to be screwed together. Accordingly, unlike other float collar bodies, there are no external threads used to connect the outside of the float collar body to the inside of the casing string.

The downhole tool also includes an annulus 111 located between an outside of the float collar body 110 and an inside of the casing string 10. The annulus 111 can have a variety of dimensions. By way of example, an annulus 111, defined as the distance between the outside of the float collar body 110 and the inside of the casing string 10, can range from 0.03 to 1 inch. According to any of the embodiments, the annulus can have dimensions selected such that the adhesive obtains a thickness in the range of 4 to 6 millimeters (mm) or more after injection into the annulus. The annulus 111 can also have a length, defined as the distance between a first end to a second end, in the range of 18 to 24 inches. According to any of the embodiments, the length of the annulus can be selected such that a desired amount of adhesive is capable to being injected into the annulus and a desired shear strength is obtained after injection. A seal 114, for example, O-rings, can be located around an outside of the float collar body 110 adjacent to the first end and optionally the second end of the annulus 111. One or more flow ports 112 can be located adjacent to the seal 114 at the first end of the annulus 111 and traverse through the float collar body 110 to provide a fluid flow path into the annulus 111.

One or more sets of wickers 113 can be positioned adjacent to the seal(s) 114 and extend outwardly away from the outer diameter (O.D.) of the float collar body 110. Accordingly, at the first end of the annulus 111 moving to the right in a direction away from the annulus in FIG. 1, the float collar body 110 can include the flow port 112, the seal 114, and a set of wickers 113. At the second end of the annulus 111 moving to the left in a direction away from the annulus in FIG. 1, the float collar body 110 can include a seal 114 and a set of wickers 113. The wickers 113 can be a plurality of discrete protrusions, for example ribs or raised periodic surfaces, that extend away from the O.D. of the float collar body 110. The protrusions can include angled, sharp edges similar to teeth of a slip wedge, packer slip, or fishing grapple that can cut into and bite the inside of the casing string 10. After biting into the inside of the casing string 10, the wickers 113 can help prevent downward movement of the float collar body 110 during landing of a plug.

The float collar body 110 is designed to receive a wide variety of float assemblies 120. Examples of float assemblies include but are not limited to flapper valves, poppet valves, plug seats, metal valves or plastic valves. The float assembly 120 can be installed within the float collar body 110 and secured within the float collar body 110 to anchor the float valve assembly to the float collar housing so the entire unit can be slid into the casing string 10 prior to run-in. The float assembly 120 can be secured within the float collar body 110 via threads (not shown) located around an outside of the float assembly 120 and the inside of the float collar body 110 or via cement 121. The inner diameter of the float collar body 110 can be customizable depending on type of float assembly 120 to be placed within the float collar body 110.

Figure 2:
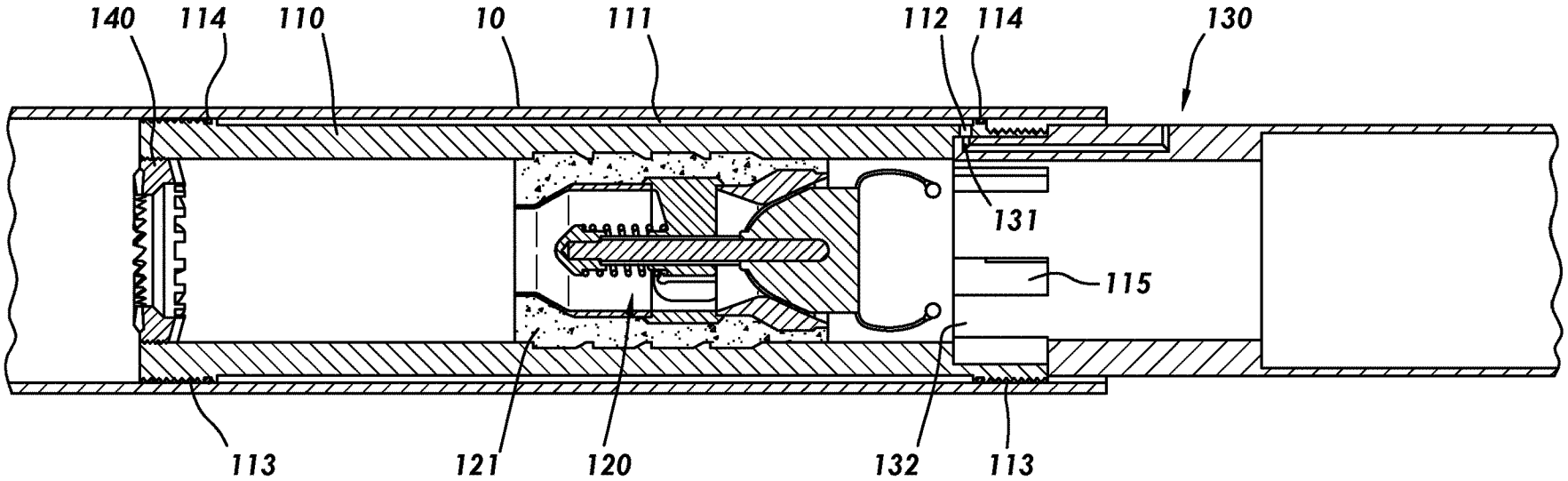
FIG. 2 is a cross-sectional view of FIG. 1 showing a seat according to certain embodiments.
Figure 3:
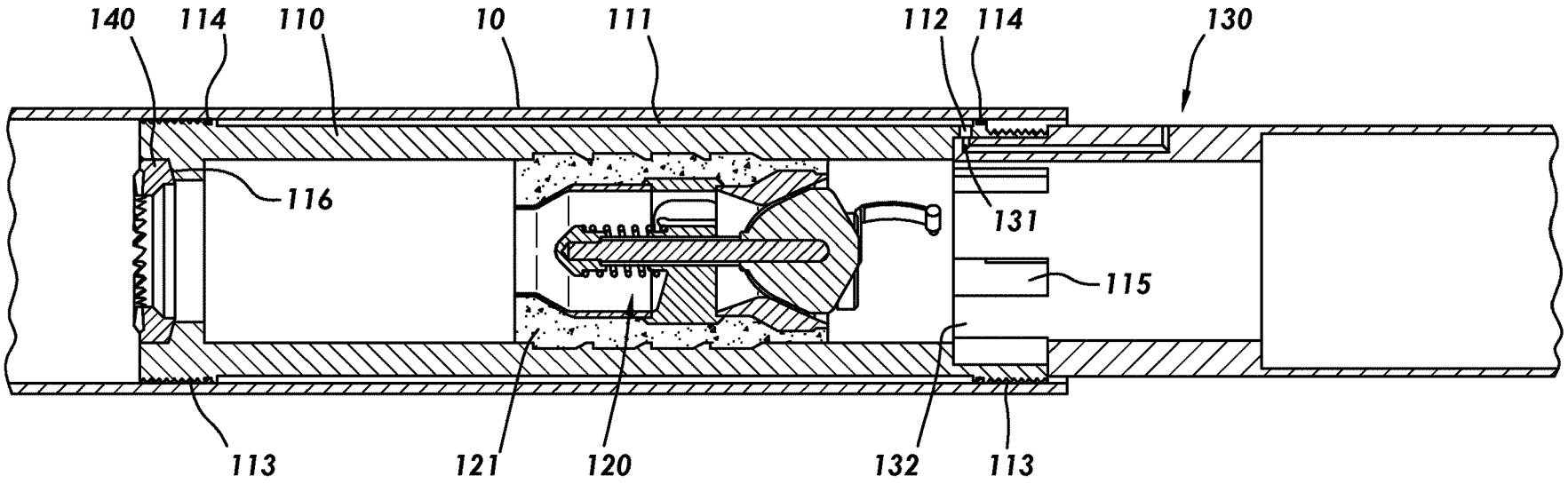
FIG. 3 is a cross-sectional view of FIG. 2 showing the seat according to certain other embodiments.

The downhole tool also includes an adhesive (not shown) located in at least a portion of the annulus 111. The adhesive attaches the float collar body 110 to the inside of the casing string 10. The adhesive can be any adhesive that attaches the float collar body 110 to the inside of the casing string 10. The adhesive can be selected such that structural integrity is maintained and the float collar body 110 does not dis-attach from the inside of the casing string 10 with application of pressure. By way of example, after the downhole tool is run into a wellbore and a cementing operation is completed, the casing string 10 can be pressure tested to ensure structural integrity of the casing string. As shown in FIGS. 2 and 3, the downhole tool can further include a non-rotating seat 140. The non-rotating seat 140 can be affixed to an inside of the float collar body 110 via an adhesive or seat threads 141. As shown in FIG. 3, the float collar body 110 can include a seat shoulder 116 that holds the non-rotating seat 140. A plug (not shown) can be dropped to land on the non-rotating seat 140 and a pressure applied to the plug to increase the pressure within the casing string 10 above the plug. Pressures during pressure testing can range from 500 to 6,000 or more pounds force per square inch (psi). Therefore, the components of the downhole tool and the adhesive should have a sufficient shear strength to enable pressure testing of the casing string 10 at the conclusion of a cementing operation. Instead of the non-rotating seat, a conventional flat landing seat, a plug landing seat, or a ball seat can be used.

Accordingly, the adhesive can be selected such that the float collar body 110 can withstand the pressures and does not dis-attach from the inside of the casing string 10 and the downhole tool has a sufficient shear strength. The adhesive can be, for example, an epoxy resin. Epoxy resins, also known as polyepoxides, are a class of reactive prepolymers and polymers which contain epoxide groups. Epoxy resins may be reacted (that is, cross-linked) either with themselves through catalytic homopolymerisation, or with co-reactants such as polyfunctional amines, carboxylic acids, acid anhydrides, phenols, alcohols, and thiols. These co-reactants are often referred to as hardeners, and the cross-linking reaction is commonly referred to as curing. Reaction of polyepoxides with themselves or with polyfunctional hardeners forms a thermosetting polymer, often with strong mechanical properties as well as high temperature and chemical resistance. The epoxy resin can comprise a diglycidyl ether functionalized molecule or any multifunctional glycidyl ether molecule. The diglycidyl ether molecule can be non-polymeric. For example, the diglycidyl ether molecule can be selected from the group consisting of a diglycidyl ether of bisphenol A, optionally blended with butyl glycidyl ether, cyclohexane dimethanol diglycidyl ether, and any combination thereof. The epoxy resin can also comprise a novolac epoxy resin.

The adhesive can also be a resin composition based on a ring-opening metathesis polymerization (ROMP) technology including a cyclic olefin and catalyst that can undergo a ring-opening metathesis polymerization reaction that transforms the resin composition into a hardened mass. The adhesive can also be a 2-part quartz filled epoxy or other 2-part epoxies having mixing ratios of each part selected according to manufacturer instructions.

The adhesive can further include a solvent or diluent to achieve the desired viscosity prior to injection into the annulus 111. A reactive diluent may be preferred because they cure into the resin network whereas solvents do not. Examples of reactive diluents are alkyl glycidyl ethers and phenyl glycidyl ethers.

If the adhesive requires mixing, such as 2-part epoxies, then the adhesive can be mixed using any type of suitable mixer. The adhesive can cure, harden, or dry after injection into the annulus 111. Curing may require a heat source to heat cure the adhesive depending on the type of adhesive used. After curing, hardening, or drying, the adhesive can form a bond between the outside of the float collar body 110 and the inside of the casing string 10 to attach the float collar body 110 to the casing string 10.

An injection sub 130 can be used to inject the adhesive into the annulus 111. The injection sub 130 can be connected to the float collar body 110 prior to injection. The float collar body 110 can include castellations 115, and the injection sub 130 can include mating castellations 132. The castellations 115/132 can centralize the injection sub 130 with the float collar body 110 inside the casing string 10 so the adhesive can be distributed evenly into the annulus 111. The injection sub 130 can include a flow port 131 that is configured to align with the flow port 112 of the float collar body 110 after the injection sub 130 is connected to the float collar body 110. The adhesive is preferably in liquid form prior to and during injection into the annulus 111. Depending on the adhesive used, the adhesive may need to be heated to allow the adhesive to flow more freely during injection. In this manner, the adhesive can be injected through the flow port 131 of the injection sub 130, flow through the flow port 112 of the float collar body 110, and enter the annulus 111. Additional flow ports 131/112 can be located circumferentially around the injection sub 130 and float collar body 110 to help ensure even distribution of the adhesive within the annulus 111. The flow ports 131/112 can also be used to remove any air located in the annulus 111 prior to injection. Removal of air can prevent air pockets from forming within the annulus 111 and around the adhesive and can create a stronger bond with the inside of the casing string 10.

Figure 4A:
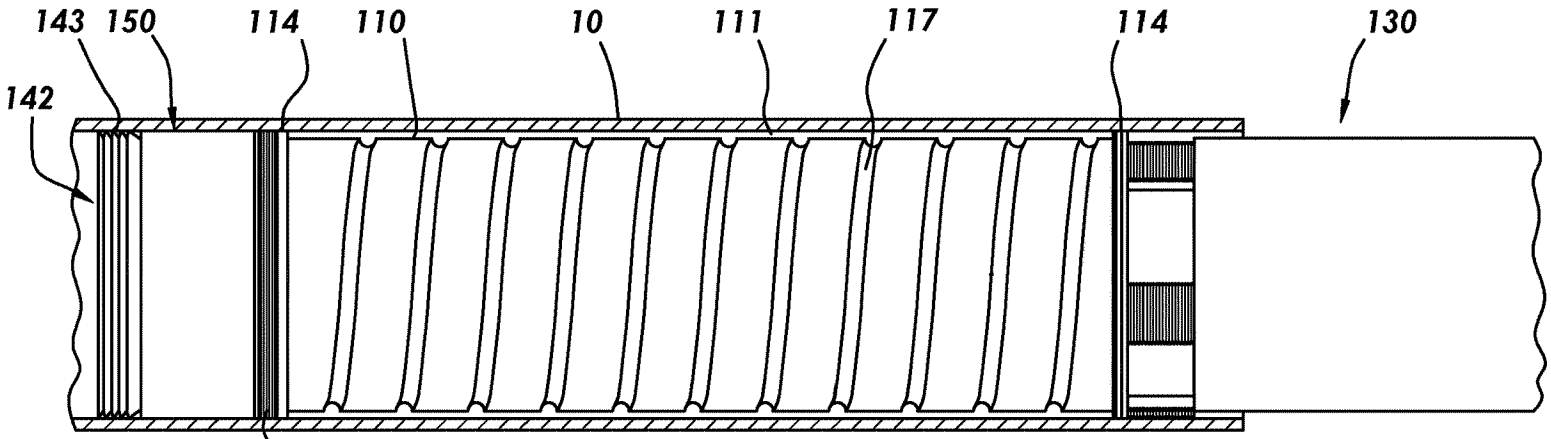
FIG. 4A is a perspective view of the float equipment showing a seat housing and seal according to certain other embodiments.
Figure 4B:
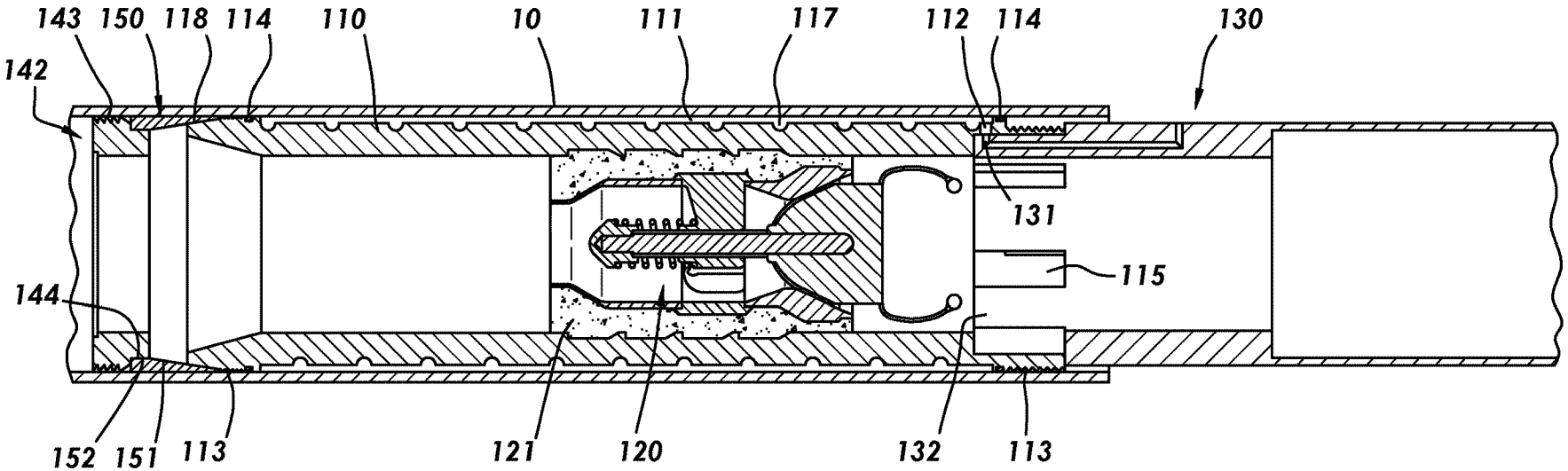
FIG. 4B is a cross-sectional view of FIG. 4A.
Figure 5:
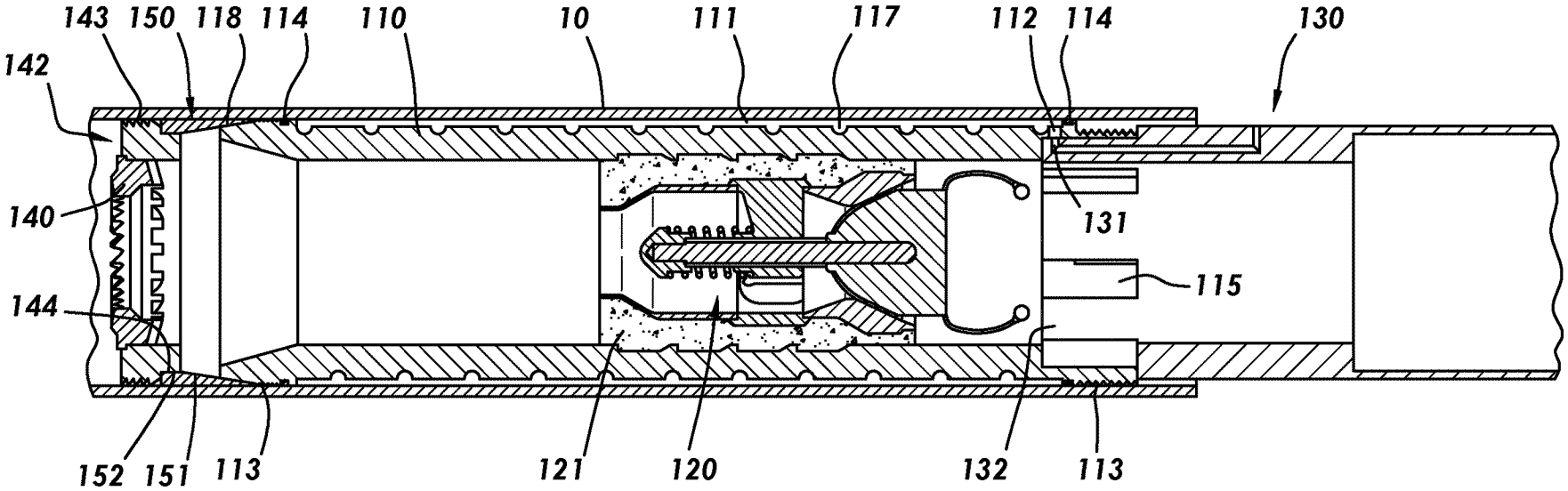
FIG. 5 is a cross-sectional view of FIG. 4B showing a seat.

The amount of adhesive injected can be sufficient to at least partially fill the annulus 111 or can be sufficient to completely fill the annulus 111. The amount of adhesive injected can be based on, in part, the shear strength of the adhesive after curing, drying, or hardening. The downhole tool can further include other components to increase the amount of bonding, contact surface area, and shear strength of the adhesive. By way of example and as shown in FIGS. 4A and 4B, the float collar body 110 can further include one or more grooves 117 on the outside of the float collar body 110 located at any point along the length of the annulus 111 or entirely along the length of the annulus 111 (shown in the figures as being located entirely along the length of the annulus 111). The grooves 117 can be oriented in a helical configuration (shown in FIG. 4A), longitudinally, or transverse to a longitudinal axis of the float collar body 110. The grooves 117 can facilitate the flow of the adhesive into the annulus 111 and increase the amount of adhesive that can be injected into the annulus 111 by increasing the surface area. The inner diameter of the casing string 10 located adjacent to the annulus 111 can be sand blasted, indented, or dimpled to increase the surface roughness of the inside of the casing string and increase the bonding of the adhesive to the casing string, which also increases the shear strength of the adhesive.

Prior to and during the adhesive injection process into the annulus 111, both ends of the annulus can be sealed such that the adhesive is retained within the annulus until the adhesive fully cures, hardens, or dries. As shown in FIGS. 4B-7, a seat housing 142 can be installed within the casing string 10 near the second end of the annulus opposite from the first end corresponding to the injection sub 130. The seat housing 142 can be installed within the casing string 10 via seat threads 143, for example. The non-rotating seat 140 can be connected to an inner diameter of the seat housing 142, for example, via threads or adhesive. A wedge-shaped seal 150 can be located between a bottom side of the seat housing 142 and a top side of the float collar body 110. As used herein, the terms "top" and "bottom" are for orientation purposes only and for a vertical wellbore, top would be located closer to the wellhead and bottom would be located farther away; and for a horizontal wellbore, top would be located closer to the vertical branching borehole and bottom would be located farther away from the vertical branching borehole. The seat housing 142 can include a seal shoulder 144 that accommodates a flat portion 152 of the wedge-shaped seal 150. The wedge-shaped seal 150 can also include a tapered portion 151. The top side of the float collar body 110 can include a sloped surface 118.

To seal the annulus 111 before and during injection of the adhesive, the seat housing 142 and wedge-shaped seal 150 can be installed within the casing string 10. The float collar body 110 can be slid into the casing string 10 such that the sloped surface 118 slides underneath the tapered portion 151 of the wedge-shaped seal 150 and the flat portion 152 of the wedge-shaped seal 150 shoulders up against the seal shoulder 144. Continued movement of the float collar body 110 towards the seat housing 142 causes the wedge-shaped seal 150 to be energized and expand radially out towards the inside of the casing string 10. After the radial expansion, the annulus 111 is sealed whereby the adhesive is inhibited or prevented from flowing out of the annulus 111.

Figure 6:
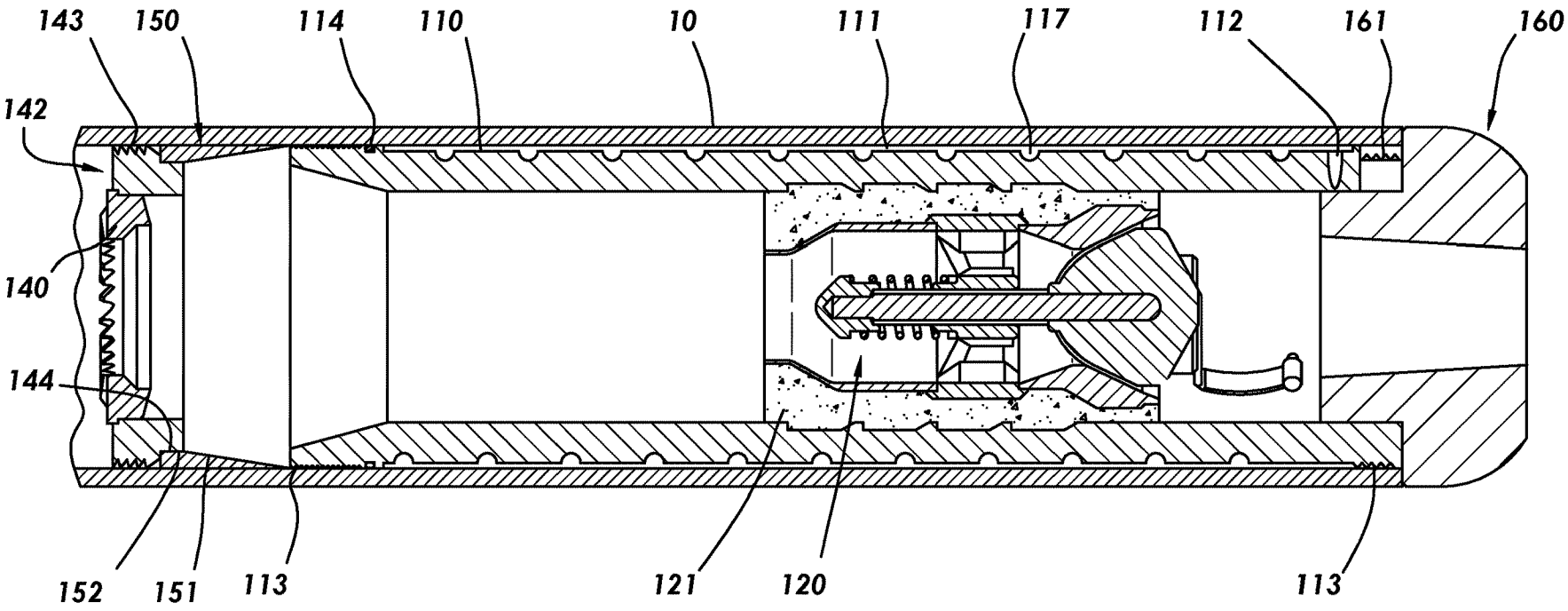
FIG. 6 is a cross-sectional view of the float equipment of FIG. 4B showing a float shoe according to certain embodiments.
Figure 7:
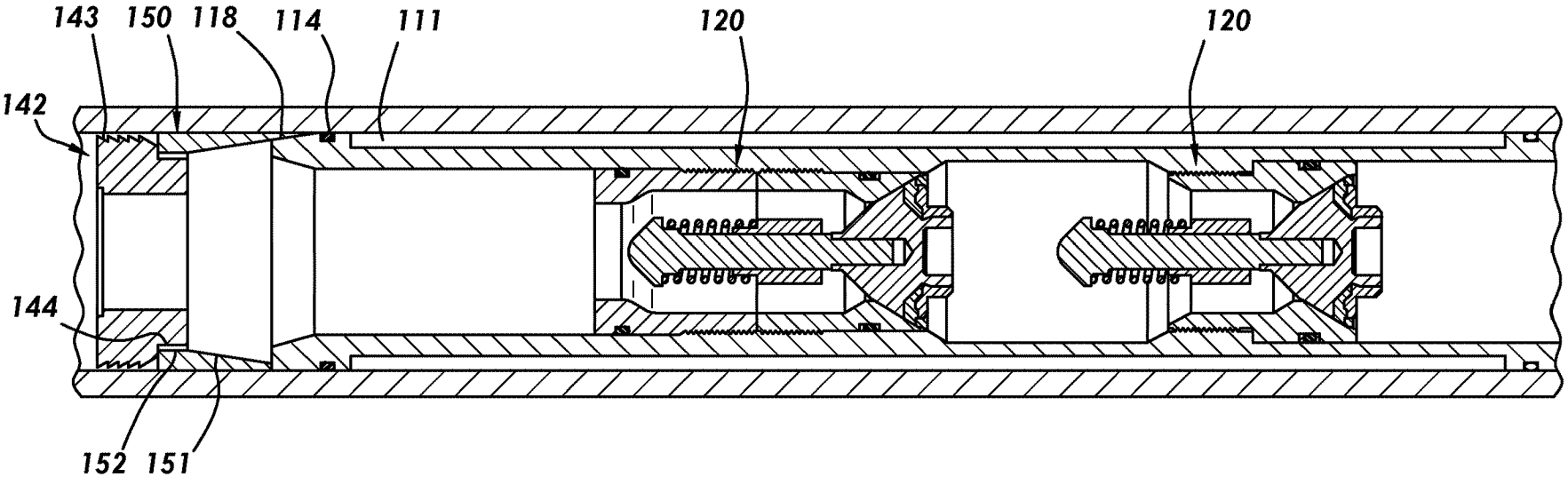
FIG. 7 is a cross-sectional view of the float equipment showing two valve assemblies according to certain embodiments.

The downhole tool can further include other components, such as, a float shoe nose 160 as shown in FIG. 6. The float shoe nose 160 can be connected to the float collar body 110 via threads 161 or via an adhesive. The float shoe nose 160 can be connected to the float collar body 110 after the adhesive has been injected into the annulus 111, the adhesive has cured, hardened, or dried, and the injection sub 130 has been removed. As shown in FIG. 7, the float collar body 110 can be configured to house more than one float assembly 120.

In practice, a method of bonding the float collar housing to an inside of the casing string can include any or all of the following: installing the seat housing 142 at a desired location within the casing string 10; installing the non-rotating seat 140 within the float collar body 110 or the optional seat housing 142; inserting the float collar body 110 optionally including the float assembly 120 into the casing string 10 by sliding the float collar body 110 into the casing string 10 in a direction towards the optional seat housing 142; threading or cementing the float assembly 120 into the float collar body 110; exerting a force onto the float collar body 110 to cause the sloped surface 118 to slide underneath the tapered portion 151 of the optional wedge-shaped seal 150 to energize the seal to engage with the inner diameter of the casing string 10; attaching the injection sub 130 to the float collar body 110 and aligning the optional castellations 115/132; injecting an amount of the adhesive into the annulus 111; causing or allowing the adhesive to cure, harden, or dry; disconnecting the injection sub 130 from the float collar body 110; and installing the float shoe nose 160. According to the embodiments without the seat housing 142 and wedge-shaped seal 150, the methods can exclude the step of exerting a force onto the float collar body 110 to cause the sloped surface 118 to slide underneath the tapered portion 151 of the optional wedge-shaped seal 150 to energize the seal to engage with the inner diameter of the casing string 10.

The length of time it takes for the adhesive to cure, harden, or dry can vary based on the type of adhesive used. The adhesive can be a rapid set adhesive, which would require a shorter time, or in the case of high-strength adhesives, can require a longer time. The injection of the adhesive occurs prior to run-in of the casing string 10 into a wellbore and can be performed on-site at the location of the cementing operation or off-site, for example at a remote location and then the casing string can be shipped to the wellsite. Accordingly, the injection of the adhesive can occur hours, days, weeks before use at a wellsite. The method steps can be performed with the casing string in a horizontal orientation, for example, on a pipe rack. Because gravity may cause the adhesive to settle to the bottom of the annulus 111 after injection and before curing, hardening, or drying, the amount of adhesive injected may be enough to completely fill the annulus 111 such that the float collar body 110 is completely bonded to the inside of the casing string 10 and no gaps exist.

Some of the many advantages to the threadless float collar body is that once the adhesive has bonded the float collar body to the inside of the casing string, compression packers are not required to keep the float collar body bonded to the casing string. There is also no way for the float collar body to burst or collapse because the annulus can be completely filled with the adhesive. This advantageously allows the float collar body to be made of different materials than other float collar bodies. Other float collar bodies are made of high-strength metals and metal alloys, which substantially increases the time to mill out after use.

The components of the downhole tool can be made from a variety of components including, but not limited to, metals, metal alloys, composites, plastics, and rubbers. According to any of the embodiments, the float collar body 110 is made from an aluminum composite material or phenolics. Not only are composite and phenolic materials lighter weight than metals used in other float collar bodies, but the time required to mill out the float collar body is substantially less.

An embodiment of the present disclosure is a downhole tool for cementing in a wellbore, the downhole tool comprising: a float collar body configured to fit within a casing string, wherein the float collar body does not include external threads; an annulus located between an outside of the float collar body and an inside of the casing string; and an adhesive located in at least a portion of the annulus, wherein the adhesive bonds the float collar body to the inside of the casing string. Optionally, the downhole tool further comprises a seal located around an outside of the float collar body adjacent to a first end of the annulus or the first end and a second end of the annulus. Optionally, the float collar body is configured to receive one or more float assemblies. Optionally, the one or more float assemblies are secured within the float collar body via threads located around an outside of the one or more float assemblies and the inside of the float collar body or via cement. Optionally, the downhole tool further comprises a non-rotating seat, a flat landing seat, a plug landing seat, or a ball seat located adjacent to a second end of the annulus. Optionally, the non-rotating seat is affixed to an inside of the float collar body via an adhesive or seat threads. Optionally, the downhole tool further comprises a seat housing installed within the casing string, and wherein the non-rotating seat is affixed to an inside of the seat housing via an adhesive or threads. Optionally, the downhole tool further comprises a wedge-shaped seal located between the seat housing and an end of the float collar body. Optionally, the adhesive is selected from an epoxy resin or a 2-part epoxy. Optionally, the adhesive cures, hardens, or dries within the annulus. Optionally, after curing, hardening, or drying, the adhesive forms a bond between the outside of the float collar body and the inside of the casing string. Optionally, the downhole tool further comprises one or more flow ports located adjacent to a seal at a first end of the annulus, wherein the one or more flow ports traverse through the float collar body to provide a fluid flow path into the annulus. Optionally, a flow port of an injection sub is configured to align with the one or more flow ports to provide a fluid flow path from the injection sub into the annulus. Optionally, an inner diameter of the casing string is sand blasted, indented, or dimpled. Optionally, the downhole tool further comprises a float shoe nose connected to the float collar body via threads or an adhesive. Optionally, the annulus is completely filled with the adhesive.

Another embodiment of the present disclosure is a method of bonding a float collar housing to an inside of a casing string comprising: inserting the float collar body into the casing string, wherein the float collar body does not include external threads; attaching an injection sub to the float collar body; injecting an adhesive into an annulus located between an outside of the float collar body and an inside of the casing string; and allowing the adhesive to cure, harden, or dry. Optionally, the float collar body includes castellations, wherein the injection sub includes castellations, and wherein attaching the injection sub to the float collar body comprises aligning the injection sub castellations with the float collar body castellations. Optionally, the float collar body and the injection sub comprise one or more fluid flow ports, and wherein the adhesive is injected into the annulus via the one or more fluid flow ports. Optionally, the method further comprises removing air within the annulus via the one or more fluid flow ports prior to injecting the adhesive into the annulus. Optionally, a seal is located around an outside of the float collar body adjacent to a first end of the annulus or the first end and a second end of the annulus. Optionally, the float collar body is configured to receive one or more float assemblies. Optionally, the one or more float assemblies are secured within the float collar body via threads located around an outside of the one or more float assemblies and the inside of the float collar body or via cement. Optionally, a non-rotating seat, a flat landing seat, a plug landing seat, or a ball seat is located adjacent to a second end of the annulus. Optionally, the non-rotating seat is affixed to an inside of the float collar body via an adhesive or seat threads. Optionally, a seat housing is installed within the casing string, and wherein the non-rotating seat is affixed to an inside of the seat housing via an adhesive or threads. Optionally, a wedge-shaped seal is located between the seat housing and an end of the float collar body. Optionally, the adhesive is selected from an epoxy resin or a 2-part epoxy. Optionally, the adhesive cures, hardens, or dries within the annulus. Optionally, after curing, hardening, or drying, the adhesive forms a bond between the outside of the float collar body and the inside of the casing string. Optionally, one or more flow ports are located adjacent to a seal at a first end of the annulus, wherein the one or more flow ports traverse through the float collar body to provide a fluid flow path into the annulus. Optionally, a flow port of an injection sub is configured to align with the one or more flow ports to provide a fluid flow path from the injection sub into the annulus. Optionally, an inner diameter of the casing string is sand blasted, indented, or dimpled. Optionally, a float shoe nose is connected to the float collar body via threads or an adhesive. Optionally, the annulus is completely filled with the adhesive.

Therefore, the apparatus, methods, and systems of the present disclosure are well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present disclosure.

As used herein, the words "comprise," "have," "include," and all grammatical variations thereof are each intended to have an open, non-limiting meaning that does not exclude additional elements or steps. While compositions, systems, and methods are described in terms of "comprising," "containing," or "including" various components or steps, the compositions, systems, and methods also can "consist essentially of" or "consist of" the various components and steps. It should also be understood that, as used herein, "first," "second," and "third," are assigned arbitrarily and are merely intended to differentiate between two or more fluids, valves, etc., as the case may be, and does not indicate any sequence. Furthermore, it is to be understood that the mere use of the word "first" does not require that there be any "second," and the mere use of the word "second" does not require that there be any "third," etc.

Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A downhole tool for cementing in a wellbore, the downhole tool comprising:

a float collar body configured to fit within a casing string, wherein the float collar body does not include external threads;

an annulus located between an outside of the float collar body and an inside of the casing string; and an adhesive located in at least a portion of the annulus, wherein the adhesive bonds the float collar body to the inside of the casing string, wherein the float collar body includes castellations, wherein an injection sub includes castellations, and wherein the injection sub castellations and the float collar body castellations are configured to be alignable for injecting the adhesive into the annulus.

2. The downhole tool according to claim 1, further comprising a seal located around an outside of the float collar body adjacent to a first end of the annulus or the first end and a second end of the annulus.

3. The downhole tool according to claim 1, wherein the float collar body is configured to receive one or more float assemblies.

4. The downhole tool according to claim 3, wherein the one or more float assemblies are secured within the float collar body via threads located around an outside of the one or more float assemblies and the inside of the float collar body or via cement.

5. The downhole tool according to claim 1, further comprising a non-rotating seat, a flat landing seat, a plug landing seat, or a ball seat located adjacent to a second end of the annulus.

6. The downhole tool according to claim 5, wherein the non-rotating seat, the flat landing seat, the plug landing seat, or the ball seat is affixed to an inside of the float collar body via an adhesive or seat threads.

7. The downhole tool according to claim 5, wherein the downhole tool further comprises a seat housing installed within the casing string, and wherein the non-rotating seat is affixed to an inside of the seat housing via an adhesive or threads.

8. The downhole tool according to claim 7, further comprising a wedge-shaped seal located between the seat housing and an end of the float collar body.

9. The downhole tool according to claim 1, wherein the adhesive is selected from an epoxy resin or a 2-part epoxy.

10. The downhole tool according to claim 9, wherein the adhesive cures, hardens, or dries within the annulus.

11. The downhole tool according to claim 10, wherein after curing, hardening, or drying, the adhesive forms a bond between the outside of the float collar body and the inside of the casing string.

12. The downhole tool according to claim 1, further comprising one or more flow ports located adjacent to a seal at a first end of the annulus, wherein the one or more flow ports traverse through the float collar body to provide a fluid flow path into the annulus.

13. The downhole tool according to claim 12, wherein a flow port of the injection sub is configured to align with the one or more flow ports to provide a fluid flow path from the injection sub into the annulus.

14. The downhole tool according to claim 1, wherein an inner diameter of the casing string is sand blasted, indented, or dimpled.

15. The downhole tool according to claim 1, further comprising a float shoe nose connected to the float collar body via threads or an adhesive.

16. The downhole tool according to claim 1, wherein the annulus is completely filled with the adhesive.

17. A method of bonding a float collar housing to an inside of a casing string comprising:

inserting the float collar body into the casing string, wherein the float collar body does not include external threads;

attaching an injection sub to the float collar body, wherein the float collar body includes castellations, wherein the injection sub includes castellations, and wherein attaching the injection sub to the float collar body comprises aligning the injection sub castellations with the float collar body castellations;

injecting an adhesive into an annulus located between an outside of the float collar body and an inside of the casing string; and allowing the adhesive to cure, harden, or dry.

18. The method according to claim 17, wherein the float collar body and the injection sub comprise one or more fluid flow ports, and wherein the adhesive is injected into the annulus via the one or more fluid flow ports.

19. The method according to claim 18, further comprising removing air within the annulus via the one or more fluid flow ports prior to injecting the adhesive into the annulus.

* * * * *